United States Patent [19]

Plapp

[11] Patent Number: 5,020,495

[45] Date of Patent: Jun. 4, 1991

[54] FUEL-METERING SYSTEM FOR INTERNAL COMBUSTION ENGINES

[75] Inventor: Günther Plapp, Filderstadt, Fed. Rep. of Germany

[73] Assignee: Robert Bosch GmbH, Stuttgart, Fed. Rep. of Germany

[21] Appl. No.: 427,858

[22] PCT Filed: Feb. 2, 1988

[86] PCT No.: PCT/DE88/00047

§ 371 Date: Oct. 4, 1989

§ 102(e) Date: Oct. 4, 1989

[87] PCT Pub. No.: WO88/08077

PCT Pub. Date: Oct. 20, 1988

[30] Foreign Application Priority Data

Apr. 4, 1987 [DE] Fed. Rep. of Germany ..... 3711398

[51] Int. Cl.[5] ..... F02D 41/12; F02D 41/34; F02M 51/00

[52] U.S. Cl. ..... 123/326; 123/493

[58] Field of Search ..... 123/493, 325, 326

[56] References Cited

U.S. PATENT DOCUMENTS

| | | | |
|---|---|---|---|
| 4,242,991 | 1/1981 | Scherenberg et al. | 123/326 |
| 4,250,853 | 2/1981 | Harada et al. | 123/493 |
| 4,327,682 | 5/1982 | Harada | 123/493 |
| 4,414,941 | 11/1983 | Nakanishi | 123/326 |
| 4,434,769 | 3/1984 | Otobe et al. | 123/493 |
| 4,452,212 | 6/1984 | Takase | 123/326 |
| 4,492,204 | 1/1985 | Bertsch et al. | 123/489 |
| 4,527,521 | 7/1985 | Hasegawa et al. | 123/326 |
| 4,697,559 | 10/1987 | Suzuki et al. | 123/325 |

FOREIGN PATENT DOCUMENTS

| | | | |
|---|---|---|---|
| 58-214626 | 12/1983 | Japan . | |
| 8222928 | 12/1983 | Japan . | |
| 59-65537 | 4/1984 | Japan . | |
| 0030446 | 2/1985 | Japan | 123/326 |
| 2138176 | 10/1984 | United Kingdom . | |
| 2167882 | 6/1986 | United Kingdom . | |

*Primary Examiner*—Tony M. Argenbright
*Assistant Examiner*—Robert E. Mates
*Attorney, Agent, or Firm*—Walter Ottesen

[57] ABSTRACT

In a fuel-metering system for internal combustion engines, the fuel metering is stopped during the overrun operation of the engine and, after overrun cutoff, is increased temporarily with respect to the metering necessary for normal operation and the instantaneous operating point of the engine, in order to accelerate with this fuel enrichment the build-up again of the fuel film in the intake pipe without impairing the composition of the fuel/air mixture. For exact apportioning of the fuel enrichment, the output signal of a lambda probe (21) characterizing the "rich mixture" is used as cutoff criterion for the fuel enrichment.

18 Claims, 1 Drawing Sheet

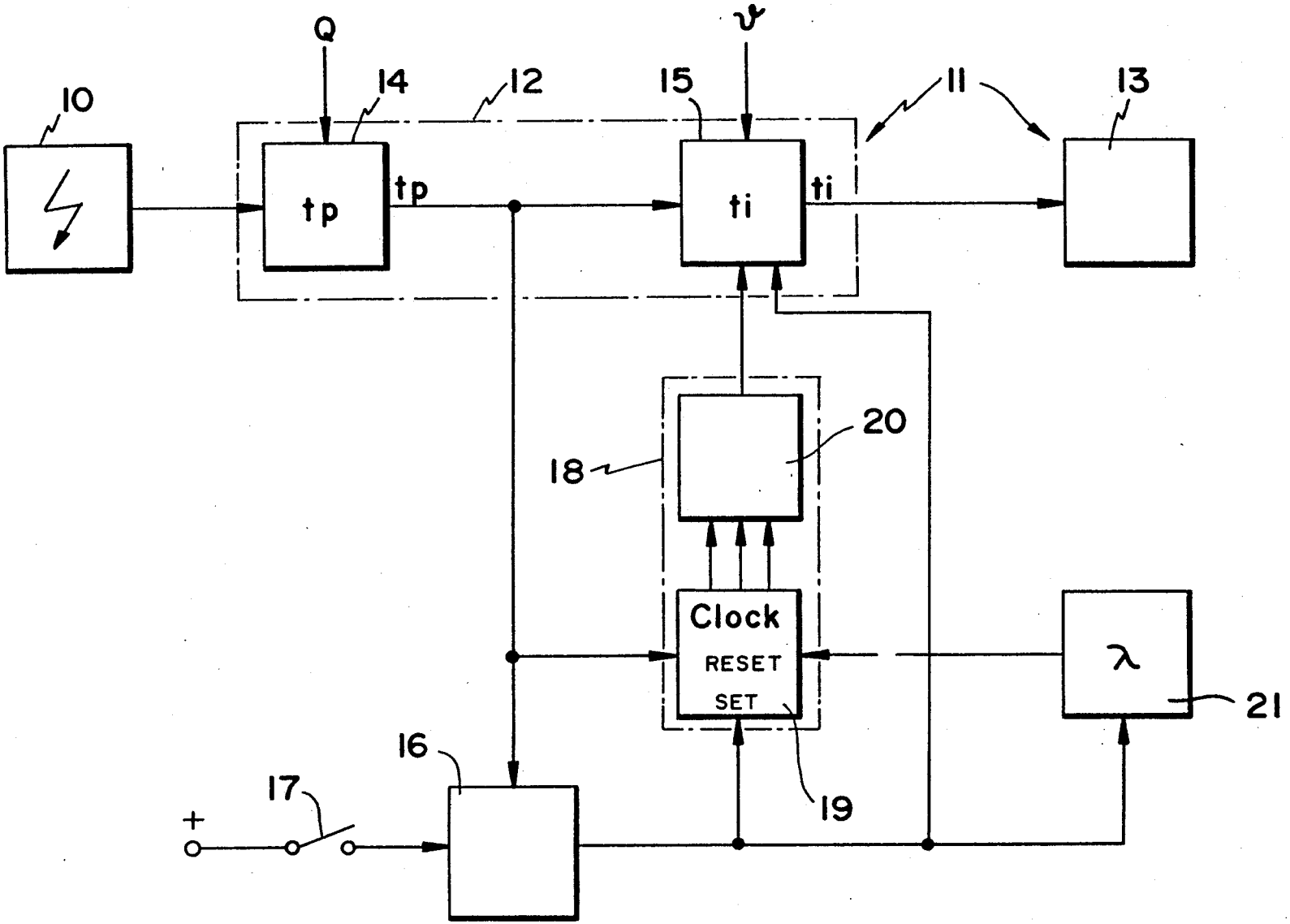
10
Q
14
tp
tp
12
15
ϑ
ti
ti
11
13
18
20
Clock
RESET
SET
19
21
λ
16
17
+

FUEL-METERING SYSTEM FOR INTERNAL COMBUSTION ENGINES

FIELD OF THE INVENTION

The invention relates to a fuel-metering system for internal combustion engines in which the quantity of fuel to be metered per ignition interval is fixed in dependence on operating characteristics of the engine such as speed, air intake quantity and temperature. In this system, the fuel metering is blocked or at least reduced at the beginning of overrun and released again at the end of overrun.

BACKGROUND OF THE INVENTION

Such a fuel-metering system is known from U.S. Pat. No. 4,242,991. In the case of this fuel-metering system, during the overrun operation of the engine, that is, when the speed with closed throttle flap exceeds a certain value, the fuel feed is entirely switched off or at least strongly throttled. After the end of the overrun operation, in particular after the end of a lengthy overrun operation, the engine along with the intake pipe may have cooled to such an extent that part of the fuel condenses on the inside surface of the intake pipe and cylinder. This part of the fuel is lost from the ignition mixture, which thus becomes too lean. As the consequence of this, the engine does not run smoothly, the speed dips excessively or the engine cuts out. In addition, hydrocarbon emission peaks occur in the exhaust gas.

In order to achieve the rapid build-up of a fuel film on the wall after overrun cutoff without impairing the quantitative balance of the metered fuel on the one hand and of the mixture fed to the cylinder for combustion on the other hand, with overrun cutoff the steady fuel quantity metered from the metering system, corresponding to the operating point of the engine, is enriched by a predetermined extra quantity of fuel. The extra quantity may in this case be constant over a certain number of ignition pulses and metering pulses coupled therewith, or may be varied with each metering pulse.

Even with variation of the extra quantity with each metering pulse, the quantity of fuel metered as a whole can always only be an inadequate compromise due to the complex interrelationships of the necessary additional wall-film quantity and the associated operating collective prehistory of the engine. The extra quantity may be too great or too small. This has the corresponding effects. An excessively rich mixture leads to carbon monoxide exhaust gas peaks, a still too lean mixture leads to hydrocarbon emission peaks and to cutting-out of the engine.

SUMMARY OF THE INVENTION

The fuel-metering system according to the invention has in comparison the advantage that, due to the provision of the lambda probe, the additional enrichment of the metered fuel quantity is interrupted when it is reliably established that there is "rich mixture". An excessively lean or rich mixture can thus be avoided to a great extent.

In the case of internal combustion engines with lambda control system (U.S. Pat. No. 4,492,204), the lambda probe already in this control system may advantageously be used. In this case, the probe signal of the lambda probe can be evaluated for the enrichment cut-off even in states of lambda control prohibition, and thus with open control loop.

BRIEF DESCRIPTION OF THE DRAWING

The invention is explained in more detail in the following description with reference to an exemplary embodiment represented in the drawing. The drawing shows a block circuit diagram of a fuel-metering system.

DESCRIPTION OF THE PREFERRED EMBODIMENTS OF THE INVENTION

In the drawing, 10 denotes a pulse generator, which triggers the ignition signals for the engine and the pulse repetition frequency of which is dependent on the speed of the engine. The pulses are fed to a fuel-metering unit 11, which consists of a metering-time setting device 12 and electromagnetic injection valves, which are combined in a block 13. The electromagnetic injection valves effect an injection of fuel into an air-intake pipe of the engine during the metering time predetermined by the metering-time setting device.

The metering-time setting device 12 has a first timing element 14 and a second timing element 15. The first timing element 14 determines a metering-time basic interval $t_p$, dependent on the speed and on an air quantity signal Q dependent on the quantity of air taken in. The second timing element 15 serves as correction stage for the metering-time basic interval $t_p$ determined in the first timing element 14 and passes to the electromagnetic injection valves a metering-time time interval $t_i$ corrected in dependence on other operating characteristics, for example a temperature signal $\nu$.

An overrun detection stage is identified by 16 and is connected to a throttle flap switch 17. The overrun detection stage 16 generates an output signal during the overrun operation, that is, when the speed of the engine exceeds a certain value with closed throttle flap and thus closed throttle flap switch 17. The speed of the engine is taken from the pulse repetition frequency of the pulse generator 10. The output of the overrun detection stage 16 is connected to the metering-time setting device 12 and at this device to the second timing element 15. The output signal here effects the blocking of the metering-time setting or an extreme reduction in the set metering-time, so that the fuel feed to the air-intake pipe is cut off, or else at least significantly throttled, for the duration of the overrun operation, via the electromagnetic injection valves in block 13. The leading edge of the output signal of the overrun detection stage 16 in this case identifies the beginning of the overrun operation of the engine, and the rear or trailing edge of the output signal of the overrun detection stage 16 identifies the end of the overrun operation. The trailing edge of the output signal of the overrun detection stage 16 is referred to below as overrun-end signal.

The overrun detection stage 16 is connected on the output side to an enrichment system 18 which, in response to the overrun-end signal, enriches the metered fuel quantity by a predetermined extra quantity of fuel and, for this purpose, controls the metering-time setting device 12 in such a way that the corrected metering-time time interval $t_i$ is extended by a predetermined time interval. The size of the extension time interval is in this case varied with each metering-time time interval $t_i$ and in such a manner that the size of the extension intervals constantly decreases, for example according to a linear or exponential function, in succeeding corrected time intervals $t_i$.

The enrichment system 18 has a digital decrementer or down-counter 19, the clock input of which is connected to the output of the first timing element 14 and is thus supplied with counting pulses whose frequency corresponds to the pulse repetition frequency of the pulse generator 10 and thus to the speed of the engine. The parallel counting outputs of the down-counter 19 are connected to a decoder stage 20. The decoder stage 20 decodes the instantaneous counting content of the down-counter 19 and passes a time extension signal, proportional to the counter reading, to the second timing element 15, which for its part increases the corrected metering-time time interval $t_i$ by an extension time interval corresponding to the time extension signal. The down-counter 19 is connected via the set input to the output of the overrun detection stage 16 in such a way that the overrun-end signal, that is the trailing edge of the output signal of the overrun detection stage 16, sets the down-counter 19 to a predetermined counter reading from which the down-counter 19 counts down with each counting pulse at its clock input.

Connected to the reset input of the down-counter 19 is the output of a lambda probe 21, which is usually arranged in the exhaust gas flow of the engine and is used for controlling the composition of the fuel/air mixture in the intake pipe. The lambda probe 21 emits in a known way control signals to an electronic control device when the mixture composition is excessively rich or excessively lean, that is, when the proportion of fuel is too great or too small. These control signals lead to corresponding correction of the mixture composition by the electronic control device. To the reset input of the down-counter 19 is passed a control pulse, which is derived from the identifying signal of the lambda probe 21 characteristic for "rich mixture", that is, increased proportion of fuel in the mixture. This control pulse causes the down-counter 19 to be reset to its "zero reading", irrespective of the instantaneous counter reading. This "zero counter reading" is likewise detected by the decoder stage 20 and correspondingly makes the time extension signal reaching the second timing element 15 zero. Consequently, the influence effected by the enrichment system 18 on the metering-time time interval $t_i$ set by the metering-time setting device 12 in dependence on the instantaneous operating point of the engine is cancelled.

To summarize, the mode of operation of the fuel-metering system described above may be described briefly in the following.

The first timing element 14 determines a metering-time basic interval $t_p$ in dependence on signals of the speed and of the air throughput in the air-intake tube. This basic interval is corrected in the second timing element 15 dependent on other operating characteristics, such as for example the temperature, and passes as corrected metering-time time interval $t_i$ to the electromagnetic injection valves of the block 13. In the overrun detection stage 16 there then occurs an output signal when the speed exceeds a certain value with closed throttle flap switch 17. With the leading edge of the output signal, the so-called overrun-begin signal, the second timing element 15 is blocked and thus the injection of fuel into the air-intake pipe of the engine by the electromagnetic injection valves 13 is stopped. The trailing edge of the output signal, the so-called overrun-end signal, cancels the injection blocking and sets the down-counter 19 to a predetermined counter reading. The down-counter 19 then begins to reduce continuously its counting content with each counting pulse, the metering-time basic intervals $t_p$ forming the counting pulses. The decoder stage 20 converts the instantaneous counting content of the down-counter 19 into a time-extension signal, the size of which is proportional to the respective counter content. The time-extension signal is fed to the second timing element 15 and here effects an increase in the corrected metering-time time interval $t_i$. Consequently, the opening time of the electromagnetic injection valves of the block 13 is increased and the fuel quantity injected into the air-intake pipe is increased. As soon as the lambda probe 21 detects "rich mixture", the down-counter 19 is reset by the output signal of the lambda probe 21. The counting content of the counter thus becomes zero, so that the decoder stage 20 converting the counting content does not pass any time-extension signal to the second timing element 15. Consequently, a switchover is again made to normal operation, in which only such a fuel quantity as the engine requires, according to the instantaneous operating characteristics, is injected via the electromagnetic injection valves in the block 13.

The invention is not restricted to the exemplary embodiment described above. For instance, the counting pulses for the down-counter 19 may be taken directly from the pulse generator 10. For speed detection by the overrun detection stage 16, the output pulses of the pulse generator 10 may also be applied to the overrun detection stage 16 instead of the metering-time basic intervals $t_p$. The enrichment system 18 may be designed in a variety of ways. In this case, instead of the linear reduction of the extension time intervals in succeeding metering-time intervals $t_i$, an exponential shortening of the extension intervals may be provided.

The subdivision of the fuel-metering system into separate functional units with clearly assigned tasks, such as metering system 11, metering-time setting device 12, overrun detection stage 16 and enrichment system 18, is not obligatory and is only used for better understanding. The tasks of these functional units are nowadays usually performed by a microprocessor or microcomputer in which certain parts and assemblies are involved simultaneously or successively in the execution of various functions, so that in this case such a clear separation cannot be accomplished.

I claim:

1. A fuel metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities;

overrun detecting means for detecting the presence of the overrun mode and for emitting a signal indicative thereof;

adjusting means for reducing said first quantity of fuel in response to said signal when the overrun mode of operation begins and for again allowing the fuel to be metered to the engine upon termination of the overrun mode;

enrichment means for acting on said adjusting means to enrich said first quantity of fuel by a predetermined additional quantity after said termination of the overrun mode;

a lambda probe for generating an identifying signal indicative of an increased fuel component in the air/fuel mixture; and means for interrupting the enrichment of said fuel quantity in response to said identifying signal.

2. The fuel-metering system of claim 1, wherein said first quantity of fuel is metered to the engine in a predetermined time duration; and, said enrichment means being adapted to cause said time duration to be extended by a pregiven time interval for enriching said first quantity of fuel.

3. The fuel-metering system of claim 1, wherein said first quantity of fuel is metered to the engine in each of a plurality of sequential time durations; said enrichment means being adapted to cause said time durations to be increased by respective pregiven time intervals for enriching the quantities of fuel corresponding to respective ones of said time durations; and, the magnitudes of said time intervals being decreased linearly.

4. A fuel metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities and in a predetermined time duration;

overrun means for reducing said first quantity of fuel when the overrun mode of operation begins and for again allowing the fuel to be metered to the engine upon termination of the overrun mode;

enrichment means for enriching said first quantity of fuel by a predetermined additional quantity after said termination of the overrun mode;

a lambda probe for generating an identifying signal indicative of an increased fuel component in the air/fuel mixture;

means for interrupting the enrichment of said fuel quantity in response to said identifying signal;

said enrichment means being adapted to cause said time duration to be extended by a pregiven time interval for enriching said first quantity of fuel;

pulse generating means operatively connected to the engine for generating pulses at ignition frequency;

said control means being connected to said pulse generator means and including means for generating an ignition signal indicative of the ignition frequency; and, said enrichment means including: a digital counter clocked by said signal and having a plurality of counting outputs; and, a decoder stage connected to said counting outputs and being adapted for generating an output signal which is a measure of the magnitude of said time interval.

5. The fuel-metering system of claim 4, said overrun means generating an overrun-end signal characteristic of the end of said overrun mode; said counter being a down counter receiving said overrun end signal for setting said down-counter to a pregiven counter reading; and, said decoder stage being configured so as to cause said output signal thereof to be proportional to the instantaneous counter reading.

6. The fuel-metering system of claim 5, said down-counter having a reset input for receiving said identifying signal with said identifying signal defining a counter reset signal.

7. The fuel-metering system of claim 6, said control means including: first time means for determining said time duration ($t_p$) in dependence upon at least one of said operating characteristic quantities; second time means connected to said first time means so as to be downstream thereof for correcting said time duration in dependence upon another operating quantity of the engine; and, said decoding stage being connected to said second time means for extending said time duration by said pregiven time interval.

8. A fuel metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities and in each of a plurality of sequential time durations;

overrun means for reducing said first quantity of fuel when the overrun mode of operation begins and for again allowing the fuel to be metered to the engine upon termination of the overrun mode;

enrichment means for enriching said first quantity of fuel by a predetermined additional quantity after said termination of the overrun mode;

a lambda probe for generating an identifying signal indicative of an increased fuel component in the air/fuel mixture;

means for interrupting the enrichment of said fuel quantity in response to said identifying signal;

said enrichment means being adapted to cause said time durations to be increased by respective pregiven time intervals for enriching the quantities of fuel corresponding to respective ones of said time durations; and, the magnitudes of said time intervals being decreased;

pulse generator means operatively connected to the engine for generating pulses at ignition frequency;

said control means being connected to said pulse generator means and including means for generating an ignition signal indicative of the ignition frequency; and, said enrichment means including: a digital counter clocked by said signal and having a plurality of counting outputs; and, a decoder stage connected to said counting outputs and being adapted for generating an output signal which is a measure of the magnitude of said time interval.

9. The fuel-metering system of claim 8, wherein said magnitudes of said time intervals are decreased linearly.

10. The fuel-metering system of claim 8, wherein said magnitudes of said time intervals are decreased exponentially.

11. The fuel-metering system of claim 1, wherein said first quantity of fuel is metered to the engine in each of a plurality of sequential time durations; said enrichment means being adapted to cause said time durations to be increased by respective pregiven time intervals for enriching the quantities of fuel corresponding to respective ones of said time durations; and, the magnitudes of said time intervals being decreased exponentially.

12. A fuel-metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities;

overrun detecting means for detecting the presence of the overrun mode and for emitting a signal indicative thereof;

adjusting means for interrupting said first quantity of fuel in response to said signal when the overrun mode of operation begins and for again allowing the fuel to be metered to the engine upon termination of the overrun mode;

enrichment means for acting on said adjusting means to enrich said first quantity of fuel by a predetermined additional quantity after said termination of the overrun mode;

a lambda probe for generating an identifying signal indicative of an increased fuel component in the air/fuel mixture; and, means for interrupting the enrichment of said fuel quantity in response to said identifying signal.

13. The fuel-metering system of claim 12, wherein said first quantity of fuel is metered to the engine in each of a plurality of sequential time durations; said enrichment means being adapted to cause said time durations to be increased by respective pregiven time intervals for enriching the quantities of fuel corresponding to respective ones of said time durations; and, the magnitudes of said time intervals being decreased linearly.

14. The fuel-metering system of claim 12, wherein said first quantity of fuel is metered to the engine in each of a plurality of sequential time durations; said enrichment means being adapted to cause said time durations to be increased by respective pregiven time intervals for enriching the quantities of fuel corresponding to respective ones of said time durations; and, the magnitudes of said time intervals being decreased exponentially.

15. A fuel-metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities and in a predetermined time duration;

overrun means for interrupting said first quantity of fuel when the overrun mode of operation begins and for again allowing the fuel to be metered to the engine upon termination of the overrun mode;

enrichment means for enriching said first quantity of fuel by a predetermined additional quantity after said termination of the overrun mode;

a lambda probe for generating an identifying signal indicative of an increased fuel component in the air/fuel mixture;

means for interrupting the enrichment of said fuel quantity in response to said identifying signal;

said enrichment means being adapted to cause said time duration to be extended by a pregiven time interval for enriching said first quantity of fuel;

pulse generator means operatively connected to the engine for generating pulses at ignition frequency;

said control means being connected to said pulse generator means and including means for generating an ignition signal indicative of the ignition frequency; and, said enrichment means including a digital counter clocked by said signal and having a plurality of counting outputs; and, a decoder stage connected to said counting outputs and being adapted for generating an output signal which is a measure of the magnitude of said time interval.

16. A fuel-metering system for an internal combustion engine having operating characteristic quantities including speed, air flow and temperature, the engine being operable in an overrun mode from time to time and the system comprising:

control means for determining a first quantity of fuel to be metered to the engine per ignition interval in dependence upon at least one of said operating characteristic quantities and in each of a plurality of sequential time durations;

overrun means for interrupting said first quantity of fuel when the overrun mode of operation begins and for again allowing the fuel to be metered to the engine upon termination of the overrun mode;

enrichment means for enriching said first quantity of fuel by a predetermined additional quantity after said termination of the overrun mode;

a lambda probe for generating an identifying signal indicative of an increased fuel component in the air/fuel mixture;

means for interrupting the enrichment of said fuel quantity in response to said identifying signal;

said enrichment means being adapted to cause said time durations to be increased by respective pregiven time intervals for enriching the quantities of fuel corresponding to respective ones of said time durations; and, the magnitudes of said time intervals being decreased;

pulse generator means operatively connected to the engine for generating pulses at ignition frequency;

said control means being connected to said pulse generator means and including means for generating an ignition signal indicative of the ignition frequency; and, said enrichment means including: a digital counter clocked by said signal and having a plurality of counting outputs; and, a decoder stage connected to said counting outputs and being adapted for generating an output signal which is a measure of the magnitude of said time interval.

17. The fuel-metering system of claim 16, wherein said magnitudes of said time intervals are decreased linearly.

18. The fuel-metering system of claim 16, wherein said magnitudes of said time intervals are decreased exponentially.

* * * * *